US006006529A

United States Patent [19]

Ji et al.

[11] Patent Number: 6,006,529

[45] Date of Patent: Dec. 28, 1999

[54] REFRIGERATOR HAVING HORIZONTAL AND VERTICAL DISPERSING BLADES

[75] Inventors: Joon Dong Ji, Suwon; Jae In Kim, Seoul, both of Rep. of Korea

[73] Assignee: Samsung Electronics Co., Ltd., Suwon, Rep. of Korea

[21] Appl. No.: 09/114,885

[22] Filed: Jul. 14, 1998

[30] Foreign Application Priority Data

| | | | |
|---|---|---|---|
| Jul. 16, 1997 | [KR] | Rep. of Korea | 97-33258 |
| Jul. 29, 1997 | [KR] | Rep. of Korea | 97-35937 |
| Oct. 2, 1997 | [KR] | Rep. of Korea | 97-51043 |

[51] Int. Cl.[6] ..... F25D 17/04

[52] U.S. Cl. ..... 62/186; 62/408

[58] Field of Search ..... 62/186, 404, 407, 62/408

[56] References Cited

U.S. PATENT DOCUMENTS

| | | | |
|---|---|---|---|
| 4,738,116 | 4/1988 | Himeno et al. | 62/186 |
| 5,191,774 | 3/1993 | Park | 62/408 |
| 5,251,814 | 10/1993 | Warashina et al. | 236/49.3 |
| 5,816,061 | 10/1998 | Lee et al. | 62/187 |
| 5,884,496 | 3/1999 | Kim et al. | 62/186 |

*Primary Examiner*—William Doerrler

*Attorney, Agent, or Firm*—Burns, Doane, Swecker & Mathis, L.L.P.

[57] ABSTRACT

Disclosed is a refrigerator having a cool air dispersing device capable of dispersing cool air horizontally and vertically. In a duct of a fresh food compartment are installed a horizontal dispersing blade for dispersing the cool air flowing thereinto horizontally and a vertical dispersing blade for dispersing it vertically. The horizontal dispersing blade is rotated by a motor, and the rotation of the motor is transmitted to the vertical dispersing blade as an elevational/de-elevational movement. Thus the vertical dispersing blade is rotated while the horizontal dispersing blade is rotated, whereby the cool air discharged into the compartment is dispersed horizontally and vertically. Therefore, the temperature in the compartment is maintained uniform.

12 Claims, 18 Drawing Sheets

REFRIGERATOR HAVING HORIZONTAL AND VERTICAL DISPERSING BLADES

BACKGROUND OF THE INVENTION

1. Field of the Invention

The present invention relates to a refrigerator having a cabinet for forming a cooling compartment, and a duct for forming a passage of cool air, which is provided in an inner wall of the cooling compartment and has at least one cool air discharge port opened into the cooling compartment, and more particularly, relates to a refrigerator having a device for dispersing cool air uniformly into the cooling compartment.

2. Prior Art

In general, a refrigerator has a cabinet for forming a pair of cooling compartments, i. e., a freezing compartment and a fresh food compartment which are partitioned by a partitioning wall, a freezing compartment door and a fresh food compartment door for opening/closing the cooling compartments respectively, and a cooling system for supplying the freezing compartment and the fresh food compartment with cool air, which comprises a compressor, a condenser and an evaporator. The cool air generated by the evaporator flows along a supply duct formed in a rear wall of each compartment, and then is supplied into each cooling compartment by a blowing fan through cool air discharge ports opened thereinto.

In such a conventional refrigerator, however, there exist an area on which the cool air discharged through the cool air discharge ports is concentrated, and an area to which a relatively small amount of cool air is supplied, so there occurs a deviation of temperature in the cooling compartments and uniform cooling cannot be achieved. Therefore, the refrigerator adopting so called tri-dimensional cooling method, which has solved such a problem has been proposed. In the refrigerator adopting the tri-dimensional cooling method, the cool air discharge ports are provided at both side walls as well as at the rear wall of the cooling compartment in order to promote the uniform cooling.

However, in such a refrigerator adopting the tri-dimensional cooling method, since the cool air is discharged through the cool air discharge ports in fixed directions, there may be still a dead-zone at an edge area which is not supplied with the cool air sufficiently. In particular, since the supply duct has to be provided not only in the rear wall but also in the side walls, there are problems that the space for storing food is reduced and the manufacturing cost increases due to the increased number of components and processes.

The uniform distribution of cool air has risen to an important problem in relation to the trend to use large-sized refrigerator.

In consideration of such a problem, the applicant of this invention has proposed a refrigerator having a device for dispersing cool air in International Patent Application WO 95/27278. FIGS. 1 through 3 are a side view, a partial enlarged sectional view, and an exploded perspective view of main elements of the refrigerator having the device for dispersing cool air.

The conventional refrigerator having the device for dispersing cool air has a pair of cooling compartments 2 and 3 in a cabinet 1, which are partitioned from each other by a partitioning wall 5. The cooling compartments 2 and 3 are called a freezing compartment 2 of relatively low temperature and a fresh food compartment 3 of relatively high temperature. On the front opening of the cooling compartments 2 and 3, doors 6 and 7 for opening/closing them are installed respectively. In the cabinet 1 is installed a cooling system comprising a compressor 11, a condenser (not shown), a freezing compartment evaporator 12*a*, and a fresh food compartment evaporator 12*b*. The cool air generated from the evaporators 12*a* and 12*b* is supplied to the corresponding compartments 2 and 3 by a freezing compartment fan 13*a* and a fresh food compartment fan 13*b* respectively.

A duct plate 9 of partial cylinder shape having cool air discharge ports 16 opened to the fresh food compartment 3 is attached to an inner wall plate 23 forming a rear inner wall surface of the fresh food compartment 3, and a supply duct 15 and a return duct 17 separated from each other by a seal plate 25 are provided between the duct plate 9 and a rear wall 4 of the cabinet 1. In the supply duct 15 is installed a duct member 21 for guiding the cool air blown by the fresh food compartment fan 13*b* downwardly. The cool air generated by the fresh food compartment evaporator 12*b* is blown by the fresh food compartment fan 13*b*, and then supplied to the fresh food compartment 3 via the supply duct 15 and the cool air discharge ports 16.

A cool air dispersing device 130 is installed in the supply duct 15. The cool air dispersing device 130 comprises a rotational shaft 131 having a vertical axis, cool air dispersing blades 132 assembled with the rotational shaft 131 in correspondence with the cool air discharge ports 16 respectively, and a driving motor 135 for rotating the rotational shaft 131. Each of the cool air dispersing blades 132 comprises three discs 136, 137 and 138 disposed in parallel with each other along the axis direction, and a first blade part 133 and a second blade part 134 disposed between the discs 136, 137 and 138. Each of the blade parts 133 and 134 are bent so that their cross section is a lax shape of alphabet S. The blade parts 133 and 134 are bent to the opposite directions to each other.

In the refrigerator having the above-described constitution, when the driving motor 131 rotates the rotational shaft 131 at a low speed, the cool air flowing along the supply duct 15 changes its flowing direction along the bent surface of the cool air dispersing blades 132, and is charged into the fresh food compartment 3 to be dispersed horizontally. Meanwhile, when the concentrative cooling on a specific area is needed, the driving motor 135 stops the rotational shaft 131 in accordance with the direction of the cool air dispersing blades 132 so that the cool air is concentrated on the specific area.

However, since the blade parts 133 and 134 of the cool air dispersing device 130 are bent to be shaped into the lax alphabet S, left or right side of the fresh food compartment 3 may not be supplied with the cool air sufficiently according to the rotational direction of the rotational shaft 131, and the smooth flow of cool air may be impeded by a vortex of the cool air formed about the cool air discharge ports 16.

Moreover, although such a conventional cool air dispersing device 130 can achieve the uniform distribution of the cool air horizontally, the vertical distribution of the cool air cannot be uniform sufficiently, so there is a limitation in realizing the uniform cooling through the overall area of the fresh food compartment 3.

SUMMARY OF THE INVENTION

The present invention has been proposed to overcome the above-described problems in the prior art, and accordingly it is the object of the present invention to provide a refrigerator having a cool air dispersing device capable of preventing vortex of cool air and achieving effectively the uniform distribution of cool air in horizontal direction and vertical direction.

To achieve the above object, the present invention provides a refrigerator having a cooling compartment for storing food, and a duct being provided in a side wall of said cooling compartment, said duct for forming a cool air passage, said duct having at least one cool air discharge port opened into said cooling compartment, said refrigerator comprising: at least one horizontal-dispersing blade of planar plate shape being installed near the cool air discharge port in said duct, said-horizontal dispersing blade being disposed vertically according to a vertical axis; a rotational shaft being connected with said horizontal dispersing blade, said rotational shaft being extended along the vertical axis; a motor for rotating said rotational shaft; at least one vertical-dispersing blade being installed near the cool air discharge port in said duct, said vertical dispersing blade being capable of pivoting about a horizontal axis; and a means for pivoting said vertical dispersing blade in a vertical direction.

It is preferable that said vertical dispersing blade pivots in a predetermined angular range.

According to a preferred embodiment of the present invention, said pivoting means comprises: a link member having a plurality of hinge assembly parts respectively assembled with said vertical dispersing blades at positions distanced from said horizontal axis, said link member being capable of moving up and down in the vertical direction; and a means for elevating/de-elevating said link member.

Here, said elevating/de-elevating means comprises: an elevation/de-elevation cam being installed on said rotational shaft of said horizontal dispersing blade, said elevation/de-elevation cam rotating together with said rotational shaft; and an operation part formed in a body with said link member, said operation part interacting with said elevation/de-elevation cam so that a rotational movement of said elevation/de-elevation cam is transmitted to said link member as an elevational/de-elevational movement thereof.

Said elevation/de-elevation cam has a cylindrical cam body coaxially installed on said rotational shaft, and a cam groove which is a closed loop having an elevational/de-elevational cam profile at an outer surface of said cam body; and said operation part protrudes from said link member and is engaged with said cam groove.

Said link member is guided by a guiding means so as to be capable of moving up and down vertically while preventing rotation thereof. Preferably said guiding means comprises: a guiding piece protruding from an axis of said link member; and a guiding part formed at an inner surface of said duct, said guiding part into which said guiding piece is inserted to be capable of moving up and down.

According to another preferred embodiment of the present invention, said elevation/de-elevation cam is implemented by a disc installed on said rotational shaft so that a plane thereof is tilted against said rotational shaft at a predetermined angle, said disc rotating together with said rotational shaft; and said operation part protrudes from said link member and is engaged with said disc.

According to still another embodiment of the present invention, said pivoting means comprises: pivoting pins protruding from said vertical dispersing blades respectively; a link member being formed with a plurality of holes along a longitudinal direction thereof with being spaced from each other at a predetermined distance, said holes for receiving said pivoting pins, said link member being capable of moving up and down in the vertical direction; an elevation/de-elevation cam being installed on said rotational shaft, said elevation/de-elevation cam rotating together with said rotational shaft; a lever member for connecting said elevation/de-elevation cam with said link member; and a lever supporting shaft for supporting said lever member to be capable of rotating so that a rotational movement of said elevation/de-elevation cam is transmitted to an elevational/de-elevational movement of said link member by a levering movement of said lever member.

Here, said elevation/de-elevation cam has a cylindrical cam body coaxially installed on said rotational shaft, and a cam groove which is a closed loop having an elevational/de-elevational cam profile at an outer surface of said cam body; and said lever member has an operation part engaged with said cam groove.

A guide plate is assembled at both ends of said horizontal dispersing blade. Said guide plate guides cool air flowing into said duct toward the cool air discharge ports.

According to he refrigerator having such a construction, a stable cool air flow and a uniform distribution of the cool air can be achieved not only in horizontal direction but also in vertical direction.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Figure 1:
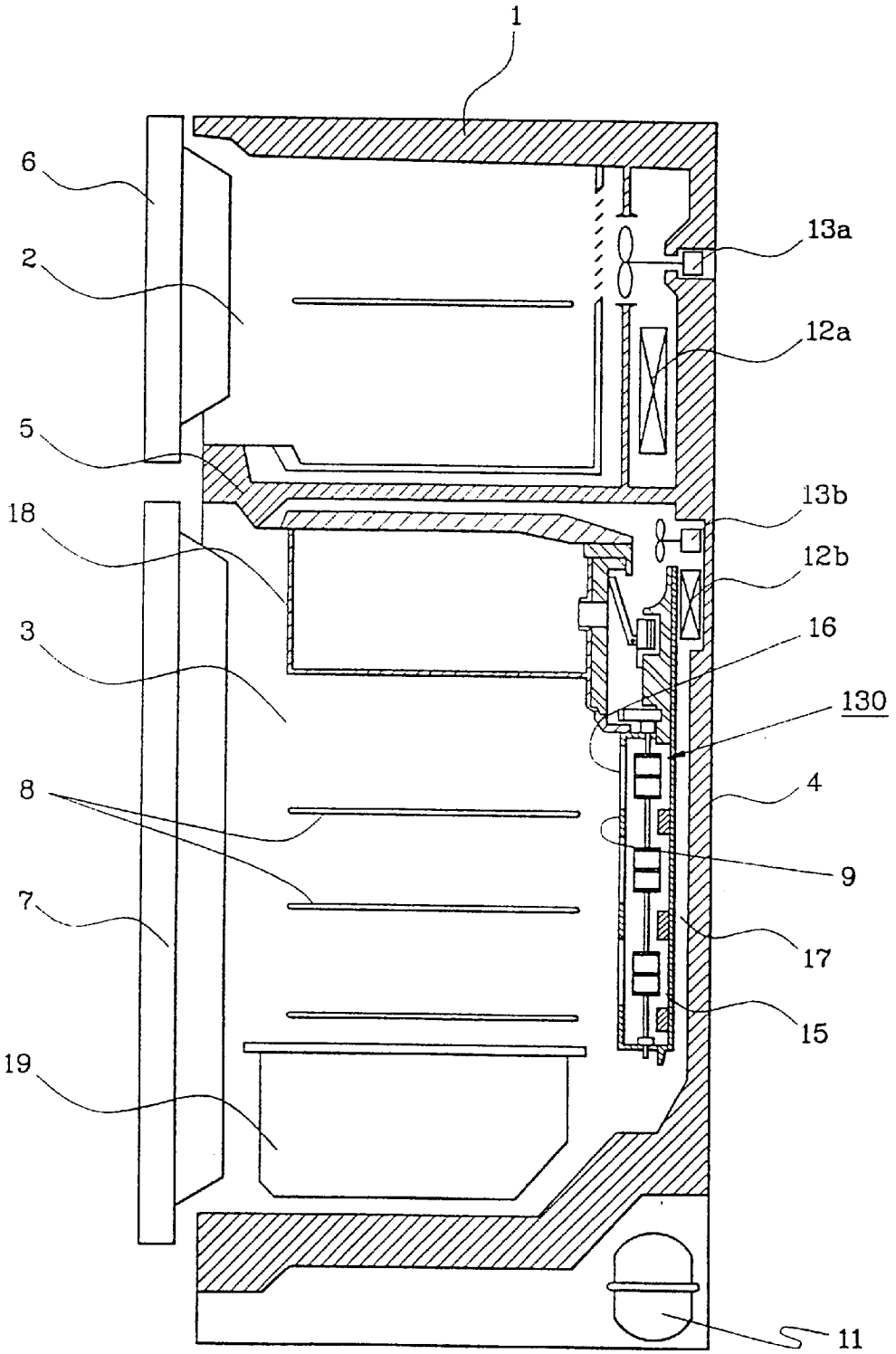
FIG. 1 (PRIOR ART)
FIG. 1 is a side sectional view of a conventional refrigerator having cool air dispersing blades.
Figure 2:
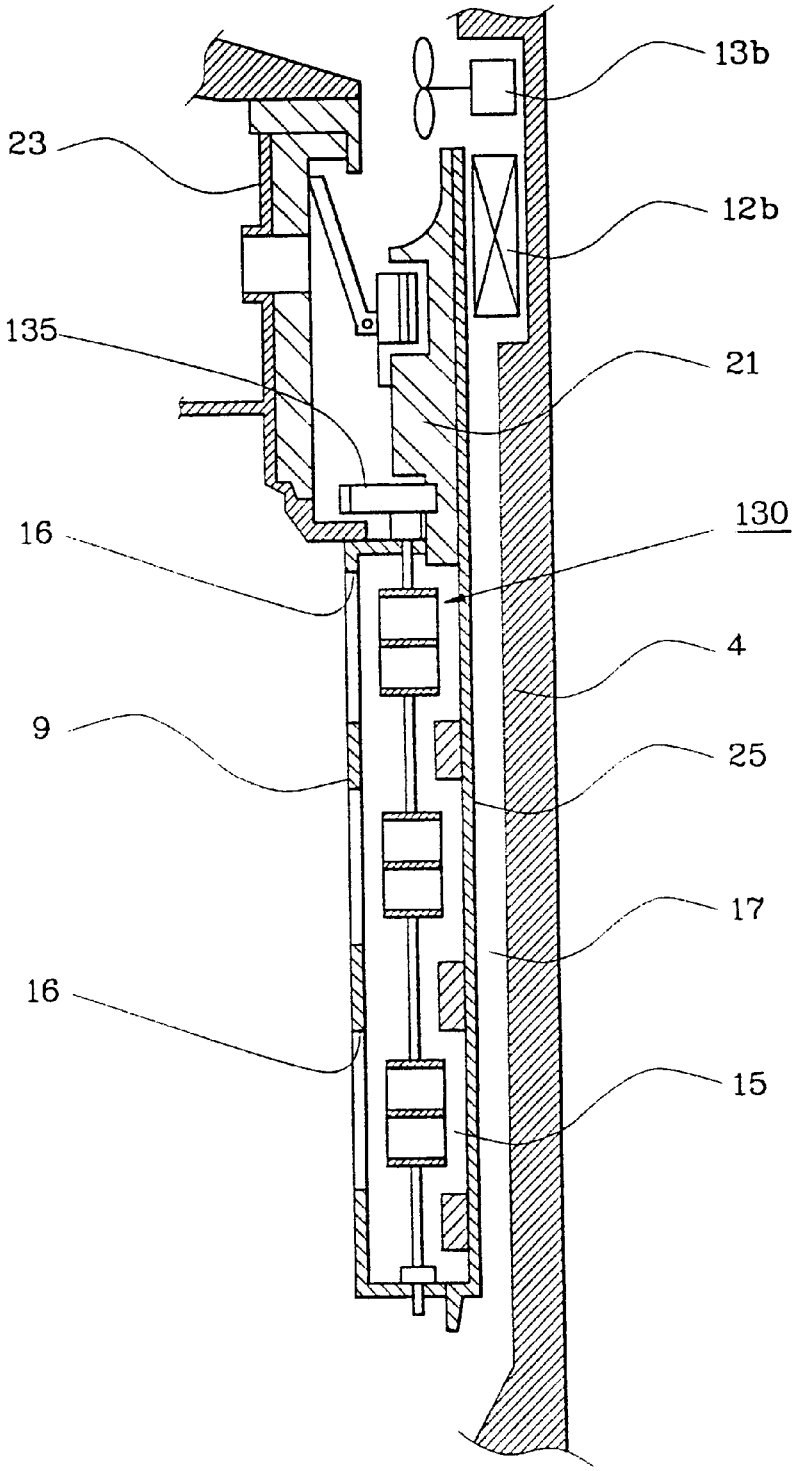
FIG. 2 (PRIOR ART)
FIG. 2 is a partial enlarged sectional view of FIG. 1.
Figure 3:
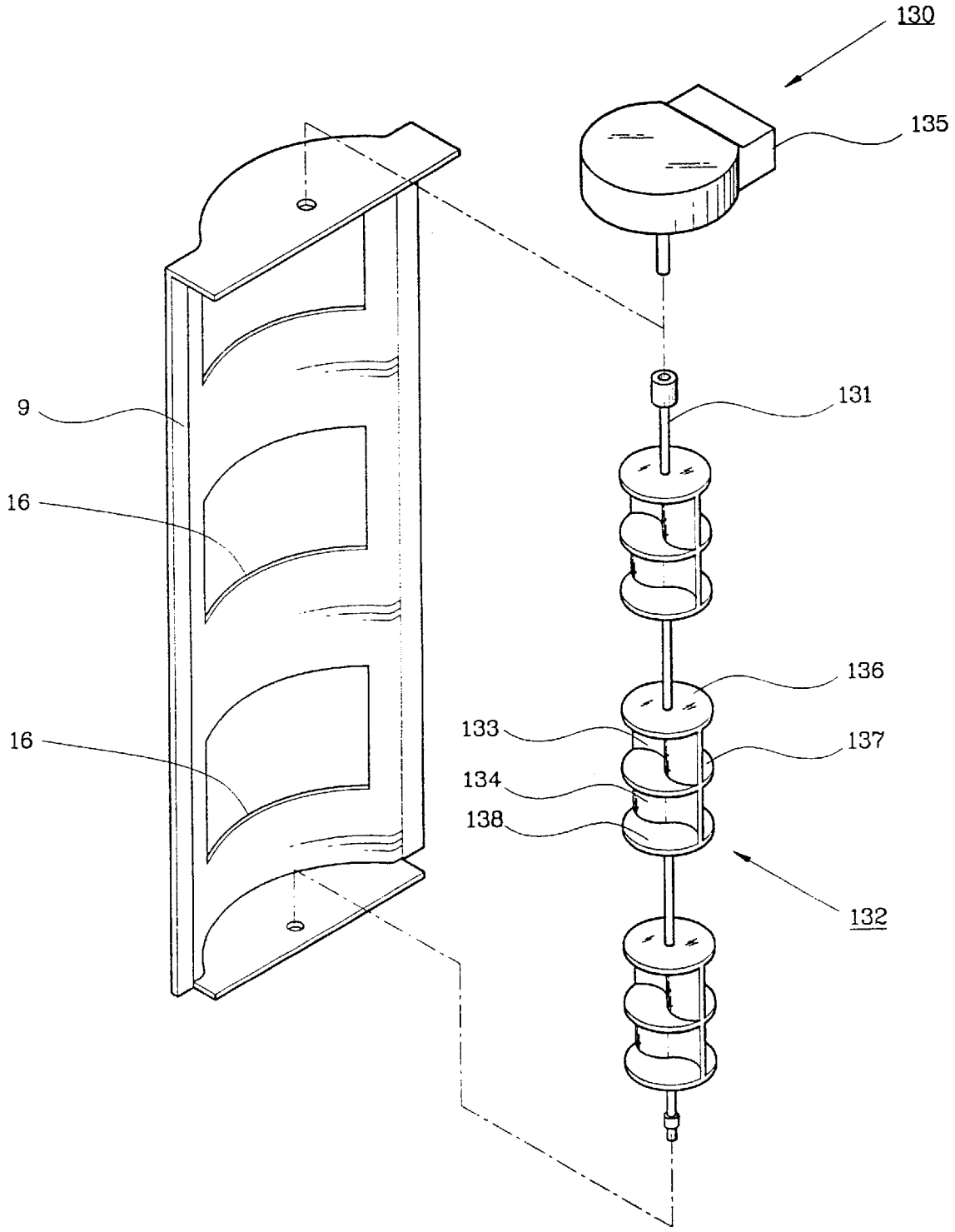
FIG. 3 (PRIOR ART)
FIG. 3 is an enlarged exploded perspective view of main elements of FIG. 2.

Hereinafter, the present invention will be described in detail with reference to the accompanying drawings. The same or similar parts with the parts shown in FIGS. 1 through 3 relating to the conventional art will be referred to with the same reference numerals. The description of the parts in each embodiment which are substantially the same with the parts of the prior art will be omitted.

Figure 4:
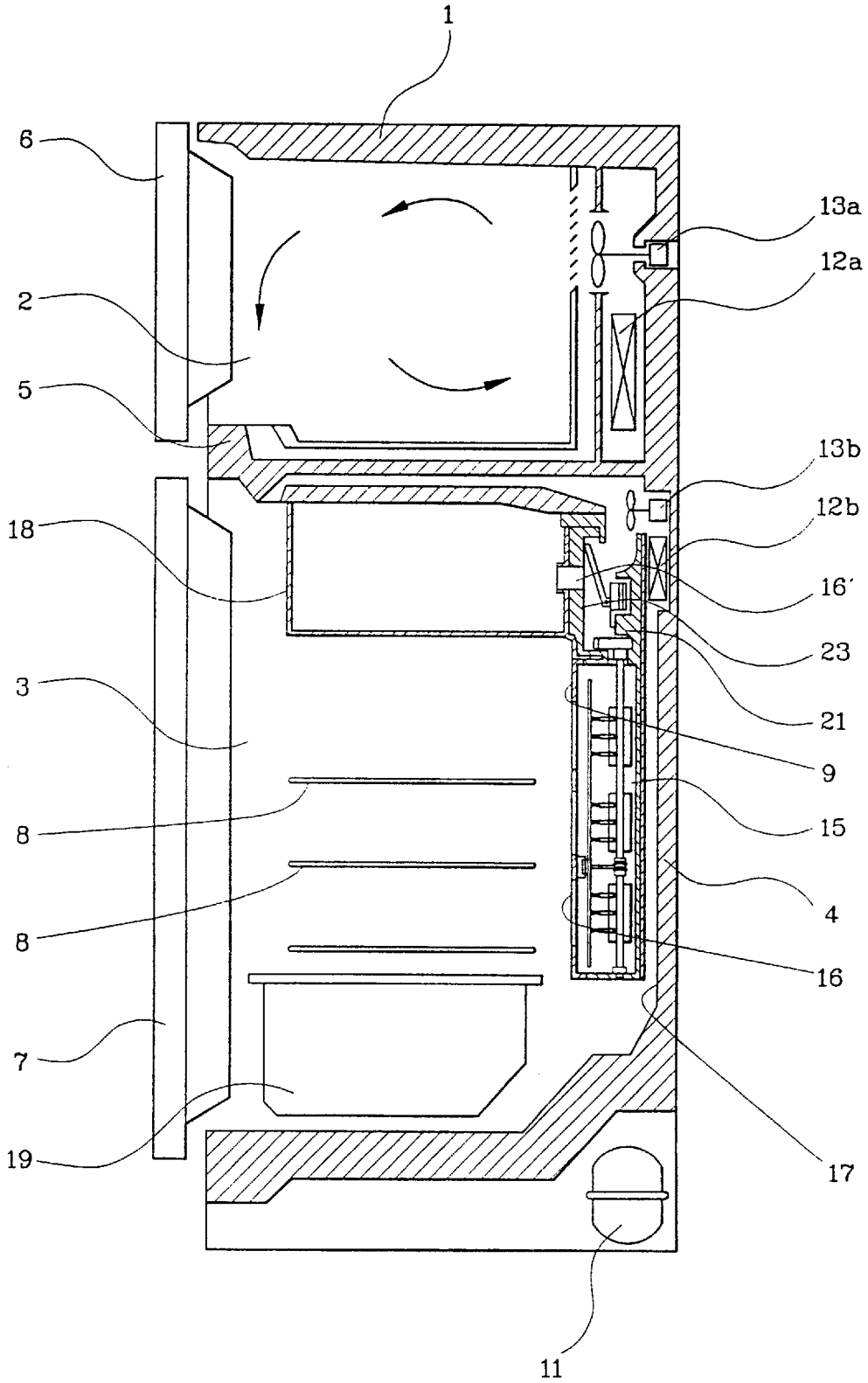
FIG. 4 is a side sectional view of a refrigerator according to the first embodiment of the present invention.

FIG. 4 is a side sectional view of a refrigerator according to the first embodiment of the present invention. The refrigerator has, as the conventional refrigerator which has been illustrated with reference to FIGS. 1 through 3, a cabinet 1 forming freezing compartment 2 and a fresh food compartment which are partitioned by a partitioning wall 5 and are disposed upper and lower parts thereof, respectively. On the front openings of the freezing compartment 2 and the fresh food compartment 3, doors 6 and 7 for opening/closing them are installed respectively. In the fresh food compartment 3, shelves 8 for placing food thereon is installed, which divide the fresh food compartment 3 into three stratified area, i. e., an upper area, a middle area, and a lower area. A special fresh chamber 18 for storing food which are proper to a specific temperature range is formed at the upper part of the fresh food compartment 3, and a vegetable chamber 19 for storing vegetables is formed at the lower part of the fresh food compartment 3.

In the cabinet 1 is installed a cooling system comprising a compressor 11, a condenser (not shown), a freezing compartment evaporator 12*a,* and a fresh food compartment evaporator 12*b*. The cool air generated by the evaporators 12*a* and 12*b* is supplied into the corresponding cooling compartments 2 and 3 by the freezing compartment fan 13*a* and the fresh food compartment fan 13*b*.

A duct plate 9 is attached on the inner wall plate 23 forming the rear inner wall of the fresh food compartment 3. The duct plate 9 is formed into a partial cylinder shape so as to protrude at the shape of an arc from the inner wall plate 23 toward the fresh food compartment 3, and has cool air discharge ports 16 opened toward the respective storing areas of the fresh food compartment 3. At the upper area of the inner wall plate 23 is provided another cool air discharge port 16' opened toward the special fresh chamber 18.

Between the duct plate 9 and the rear wall 4 of the cabinet 1, a supply duct 15 and a return duct 17 are provided, which are partitioned from each other by a seal plate 25. In the supply duct 15, a duct member 21 for guiding the cool air blown by the fresh food compartment fan 13*b* downwardly is installed. The cool air generated by the fresh food compartment evaporator 12*b* is blown by the fresh food compartment fan 13*b* so as to be supplied into the fresh food compartment 3 via the supply duct 15 and the cool air discharge ports 16. A device for dispersing the cool air horizontally is installed in the supply duct 15.

Figure 5:
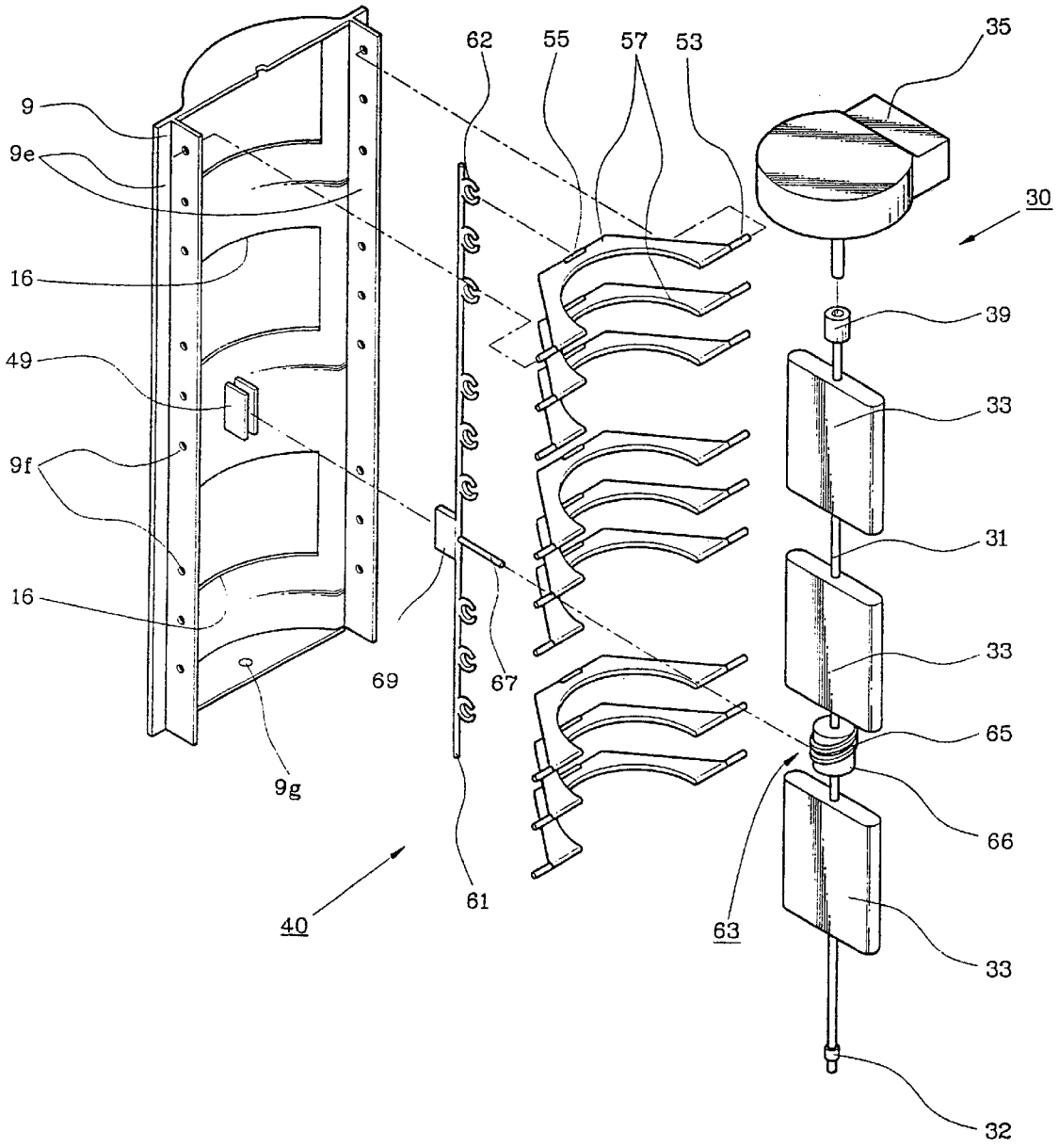
FIG. 5 is an exploded perspective view of the cool air dispersing device of FIG.

FIG. 5 is an exploded perspective view of the cool air dispersing device of FIG. 4. The refrigerator according to the present invention has a device 30 for dispersing cool air horizontally and a device 40 for dispersing the cool air vertically.

The horizontal dispersing device 30 has a rotational shaft 31 having a vertical axis, three horizontal dispersing blades 33 having the shape of a planar plate, and a driving motor 35 for rotating the rotational shaft 31. Those blades 33, which extend vertically, are called "horizontal" dispersing blades because they control the horizontal dispersing of air. Three horizontal dispersing blades 33 are disposed near the respective cool air discharge ports 16 formed on the duct plate 9 along an axis direction. A coupling part 39 being coupled with a driving shaft 36 of the driving motor 35 is provided at the upper end of the rotational shaft 31, and a journal part 32 supported rotatably by being inserted into a bearing hole 9*g* formed at the lower area of the duct plate 9 is provided at the lower end of the rotational shaft 31. It is preferable that the driving motor 35 is a stepping motor which is capable of controlling angular stop position.

Then, when the driving motor 35 operates, the horizontal dispersing blades 33 are rotated by the rotational shaft 31, and thereby the cool air discharged through the cool air discharge ports 16 is dispersed horizontally.

The vertical dispersing device 40 comprises a plurality of vertical dispersing blades 57 which are disposed near the cool air discharge ports 16 and capable of pivoting about a horizontal axis, a link member 61 installed in the supply duct 15 to be capable of moving up and down, and an elevation/de-elevation cam 63 for elevating/de-elevating the link member 61. Those blades 57 are called "vertical" dispersing blades because they control the vertical dispersing of air.

The vertical dispersing blade 57 is formed into an arc plate so as to accommodate the horizontal dispersing blades 33, and a horizontal rotational shaft 53 is extended along a horizontal axis thereof at the left and right ends thereof. In correspondence with it, the duct plate 9 is formed with flange parts 9*e* which are extended backward from the rear surface of both side edges thereof and are facing to each other, and the flange parts 9*e* are formed with a plurality of shaft holes 9*f* for receiving and rotatably supporting the horizontal rotational shaft 53. The vertical dispersing blades 57 are capable of pivoting in the cool air discharge ports 16 while the horizontal rotational shaft 53 thereof is inserted into the shaft holes 9*f*.

The link member 61 is disposed in parallel with the rotational shaft 31. The link member 61 is formed into the shape of a rod, and has a plurality of hinge assembly parts 62 which have the shape of a partial ring and protrude toward the vertical dispersing blades 57. In correspondence to the hinge assembly parts 62, each of the vertical dispersing blades 57 has a hinge part 55 at the inner central area thereof, which is formed into a cylinder disposed along the horizontal direction. The hinge assembly parts 62 are engaged with the hinge parts 73 to be capable of rotating relatively thereto.

The elevation/de-elevation cam 63 is installed on the rotational shaft 31 of the horizontal dispersing device 30. The elevation/de-elevation cam 63 is comprised of a cylindrical cam body 66, and a cam groove 65 formed on the outer surface of the cam body 66. The cam groove 65 is a closed loop having an elevational/de-elevational cam profile along the cylindrical surface. On the link member 61 is provided an operation part 67 protruding transversely to the longitudinal direction thereof, and the free end of the operation part 67 is inserted into the cam groove 65 of the elevation/de-elevation cam 63.

Furthermore, the link member 61 has a guiding piece 69 protruding toward the duct plate 9, and the guiding piece 69 is accommodated in the elevation/de-elevation guiding part 49 formed on the inner wall of the duct plate 9.

The elevation/de-elevation guiding part 49 accommodates the guiding piece 69 to be capable of guiding it up and down and preventing the link member 61 from rotating about the axis thereof.

The operation of the refrigerator according to the present invention having such a construction is as follows.

Figure 6:
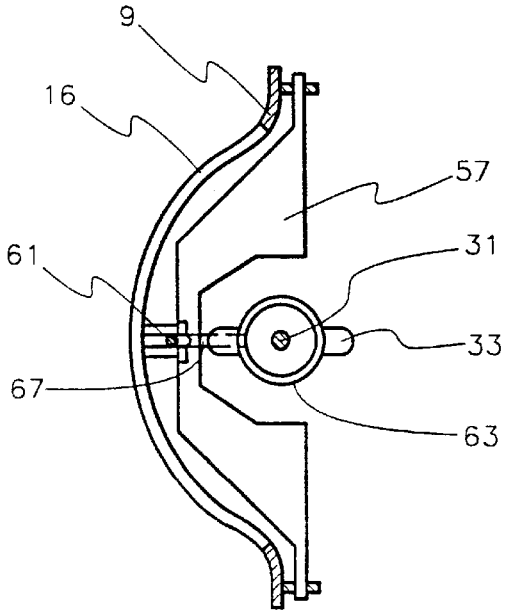
FIGS. 6 through 8 are enlarged transverse sectional views showing the cool air dispersing process performed by the horizontal dispersing blades successively.
Figure 7:
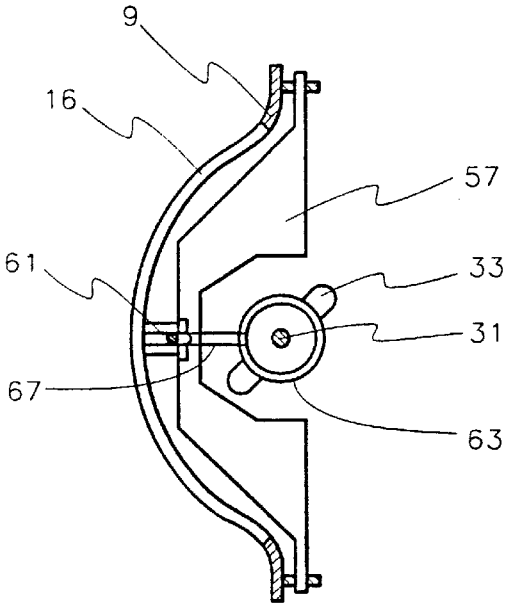
Figure 8:
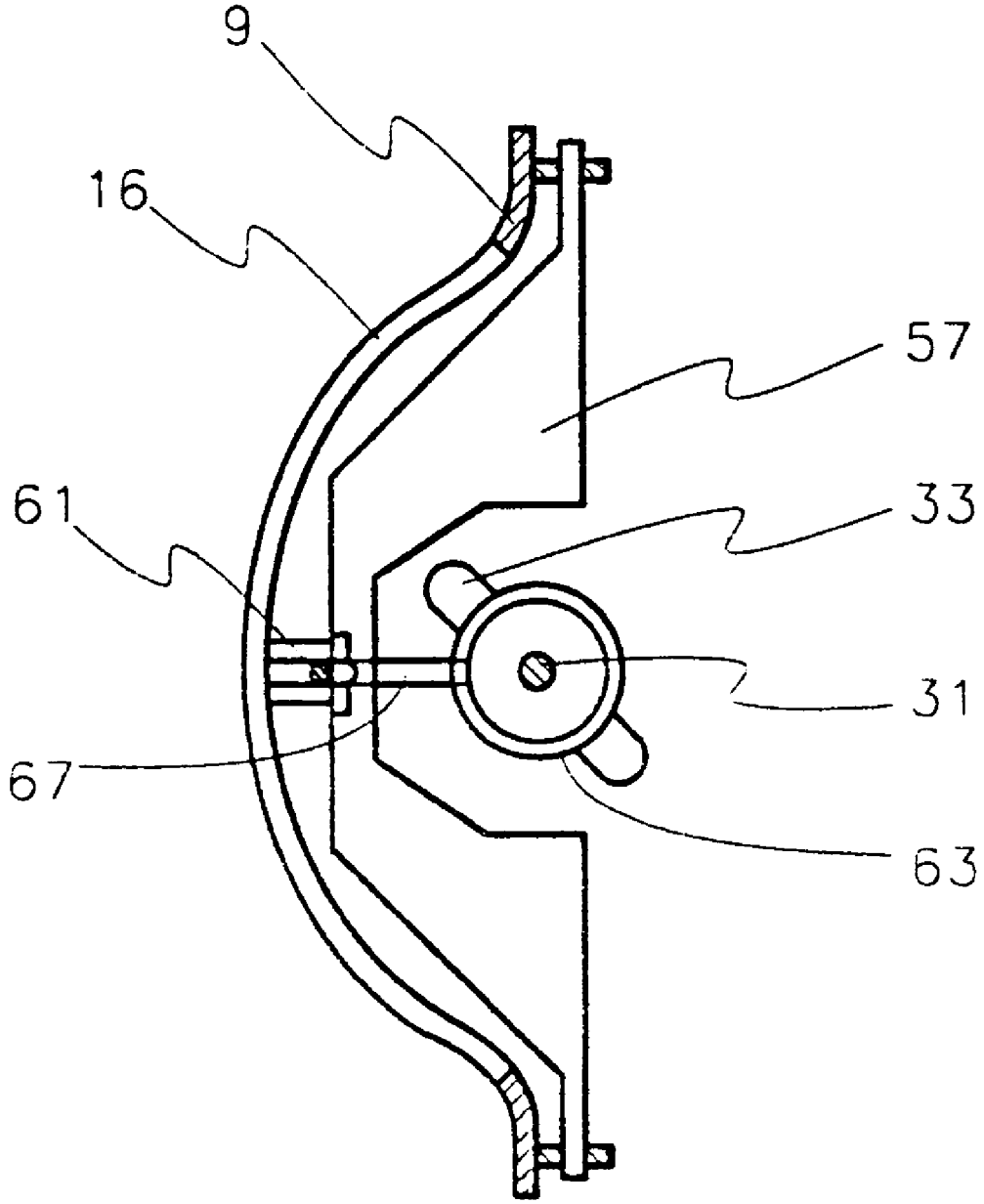

FIGS. 6 through 8 are transverse sectional views showing the discharging state of the cool air while the horizontal dispersing blades 33 are rotating. As shown in the figures, the horizontal dispersing blades 33 of the cool air dispersing device 30 rotate at 360 degrees as the driving motor 35 operates. When the horizontal dispersing blades 33 are directed to the front side as shown in FIG. 6, the cool air in the supply duct 15 is discharged to the front side along both sides of the horizontal dispersing blades 33. When the horizontal dispersing blades 33 are rotated to the left side or the right side as shown in FIGS. 7 and 8, the cool air is discharged toward the left side or the right side.

As described, the discharge direction of the cool air is consecutively changed as the angular position of the horizontal dispersing blades 33 is changed, so the cool air is dispersed into the fresh food compartment 3 uniformly. Moreover, since the horizontal dispersing blades 33 are formed into the shape of a planar plate, there is no vortex caused by the rotation of the horizontal dispersing blades 33.

Furthermore, if the concentrative supply of the cool air on a specific area such as left side or right side is required, the concentrative cooling can be realized by stopping the driving motor 35 when the horizontal dispersing blades 33 is directed to the corresponding area. In such a situation, temperature sensors placed at a plurality of positions in the fresh food compartment 3, as well as a control part for controlling the driving motor 35 on the basis of the sensing signal from the temperature sensors have to be provided.

Meanwhile, in the present embodiment, horizontal dispersing blades 33 are disposed in correspondence to the cool air discharge ports 16, however, it is possible that only one horizontal dispersing blade is extended throughout all of the cool air discharge ports 16.

While the horizontal dispersing device 30 operates to rotate the rotational shaft 31, the elevation/de-elevation cam 63 rotates together therewith, and the link member 61 is elevated/de-elevated by the operation part 67 engaged with the cam groove 65 of the elevation/de-elevation cam 63. The elevational/de-elevational movement of the link member 61 causes the pivoting of the vertical dispersing blades 57 relatively to the horizontal rotational shaft 53 through the hinge assembly part 62 and the hinge part 55 of the vertical dispersing blades 57.

Meanwhile, the elevation and de-elevation of the link member 61 is guided vertically by the guiding piece 69 and the elevation/de-elevation guiding part 49. Therefore, the link member 61 does not rotate but reciprocates in the vertical direction while the elevation/de-elevation cam 63 rotates.

Figure 9:
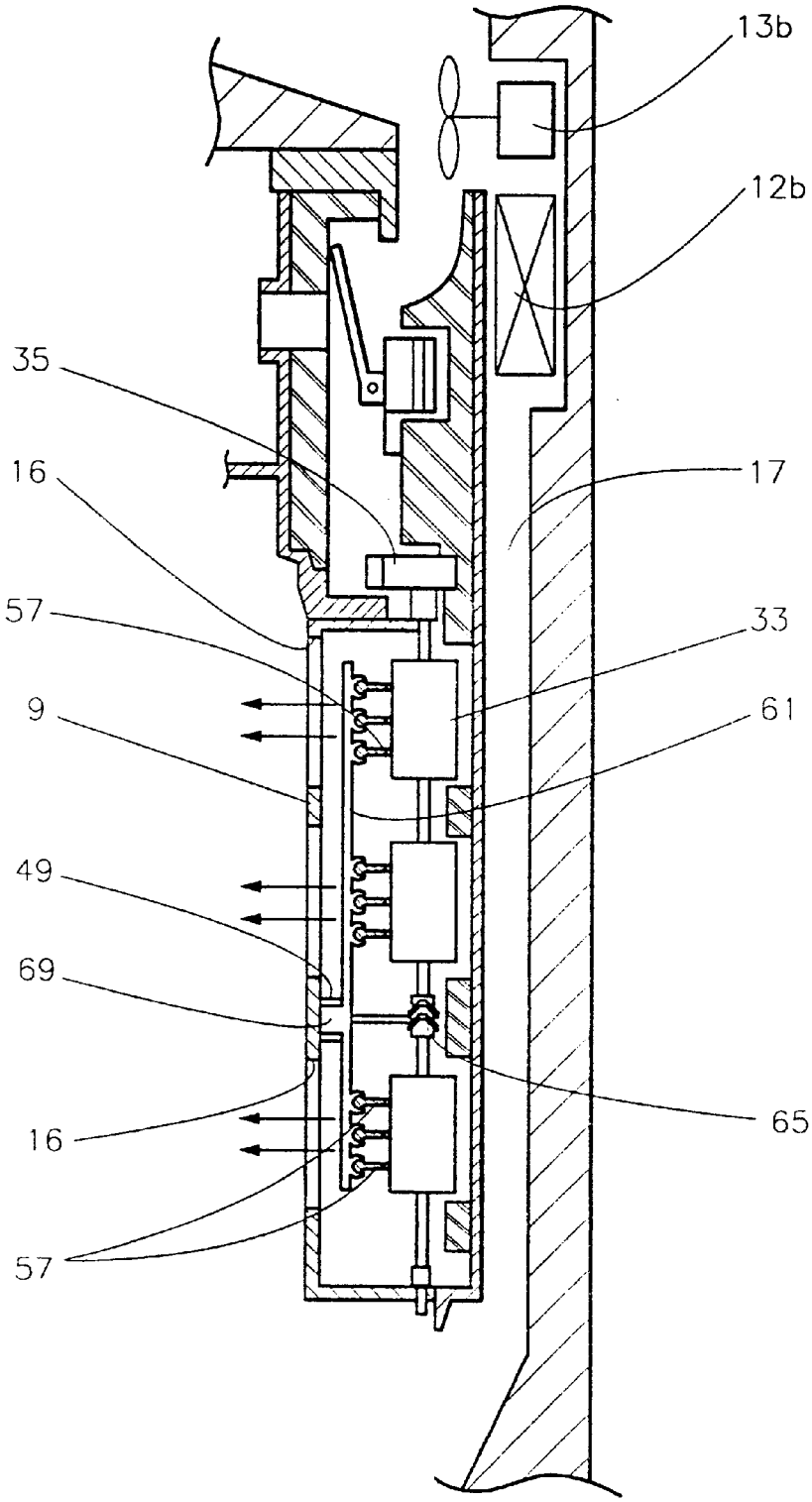
FIGS. 9 through 11 are enlarged side sectional views showing the cool air dispersing process performed by the vertical dispersing blades successively.
Figure 10:
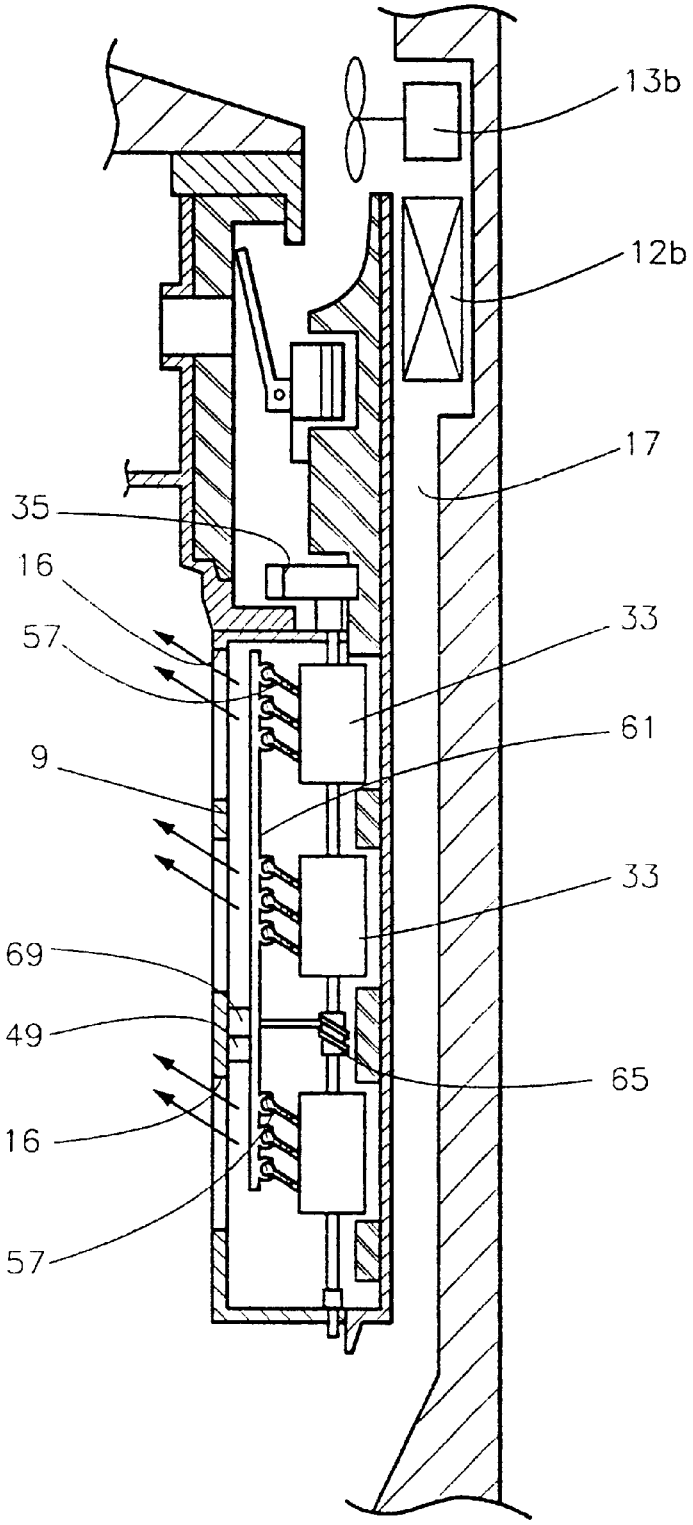
Figure 11:
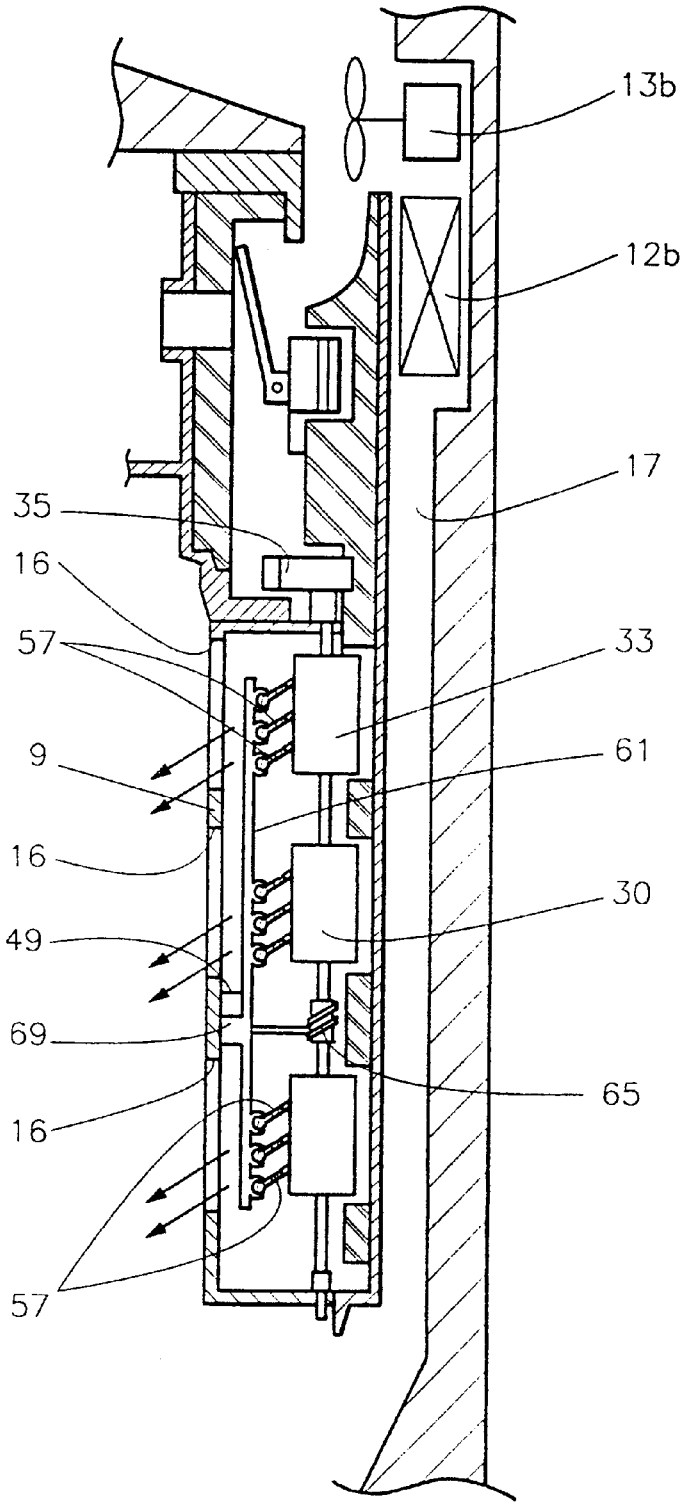

FIGS. 9 through 11 are side sectional views showing the elevational/de-elevational movement of the vertical dispersing blades 57 caused by the rotation of the rotational shaft 31. As shown in FIG. 9, while the vertical dispersing blades 71 are kept horizontal, the cool air is discharged horizontally. When the rotational shaft 31 rotates at about 90 degrees, the vertical dispersing blades 57 are tilted upward as shown in FIG. 10, and in such a situation, the cool air is discharged upward to be supplied into the upper area of the fresh food compartment 3. As the rotational shaft 31 further rotates at about 90 degrees from the position shown in FIG. 10, the vertical dispersing blades 57 are returned to the horizontal state as shown in FIG. 9, and as it further rotates at about 90 degrees, the vertical dispersing blades 57 are tilted downward as shown in FIG. 11. In such a situation, the cool air is discharged downward.

As described above, since the vertical dispersing device 40 operates together with the horizontal dispersing device 30, the cool air is supplied uniformly along the vertical direction and the horizontal direction.

Figure 12:
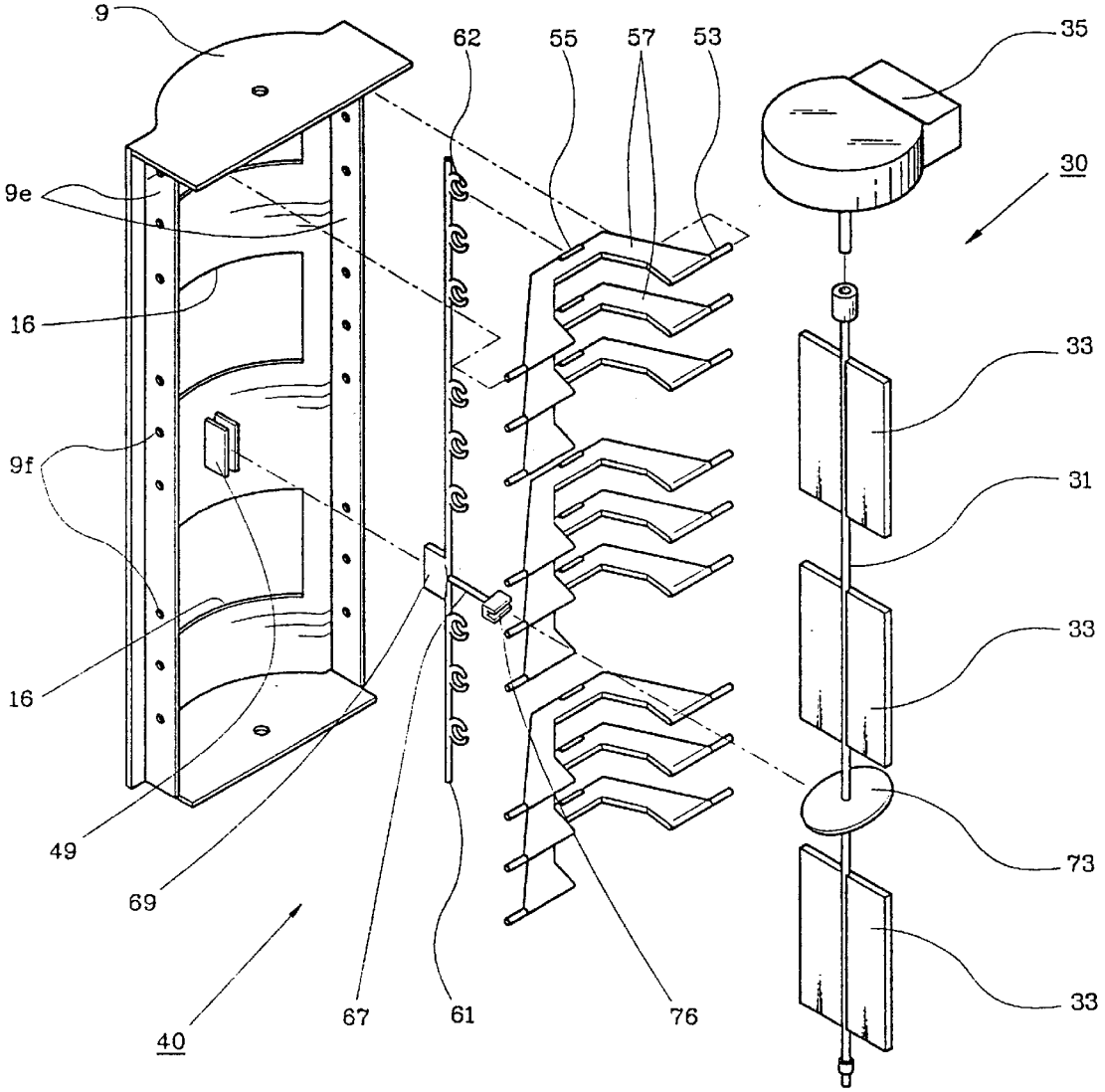
FIG. 12 is an exploded perspective view of the cool air dispersing device according to the second embodiment of the present invention.
Figure 13:
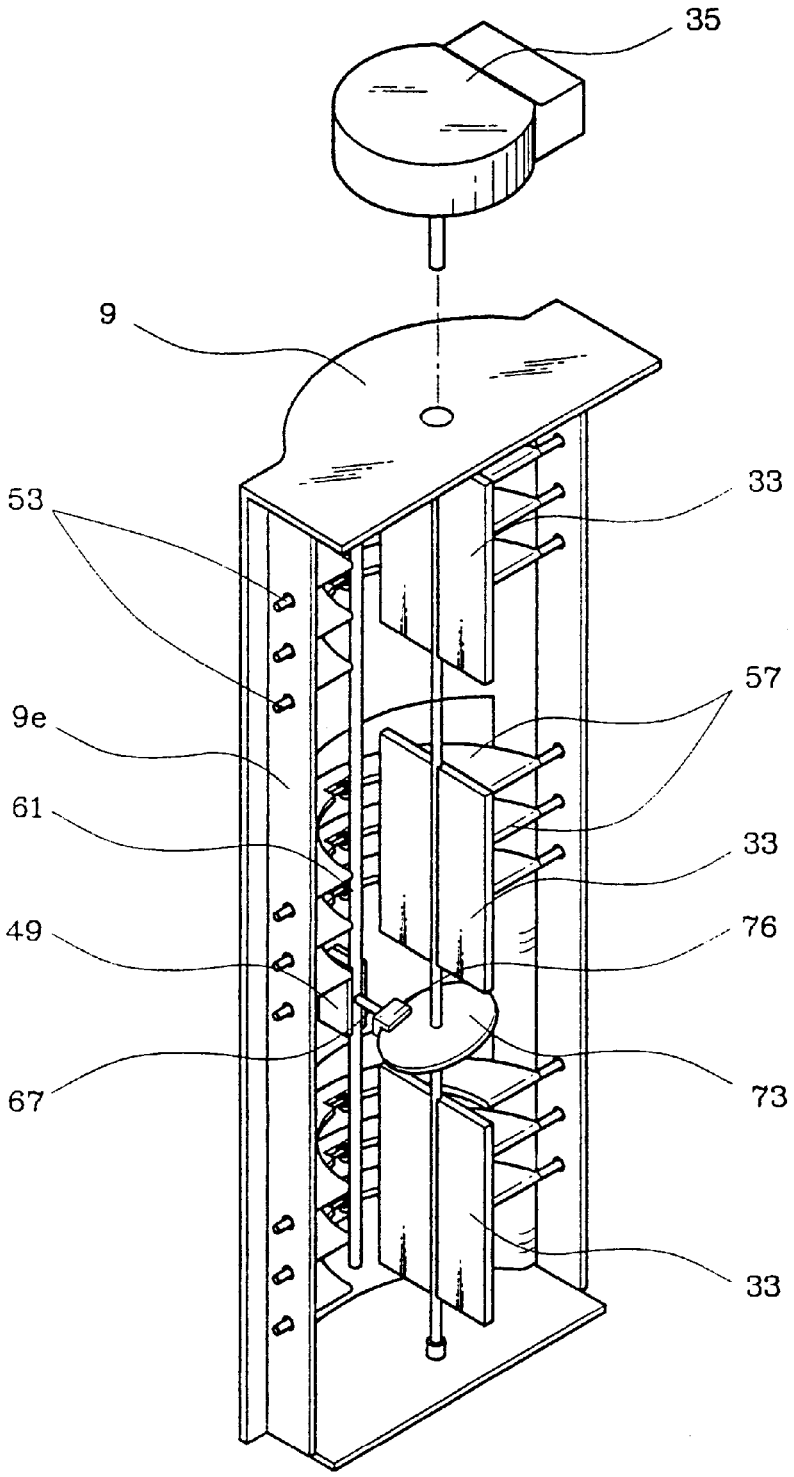
FIG. 13 is a perspective view of an assembled state of FIG. 12.

FIG. 12 is an exploded perspective view of the cool air dispersing device according to the second embodiment of the present invention, and FIG. 13 is a perspective view of an assembled state of FIG. 12. In this embodiment, the construction of the horizontal dispersing device 30 and the vertical dispersing device 40 is substantially the same with that of the above-described first embodiment. However, the construction of the elevation/de-elevation cam 73 is different from that of the first embodiment.

In the present embodiment, the elevation/de-elevation cam 73 is comprised of a disc 73 which is installed on the rotational shaft 31 and is tilted against the rotational shaft 31 at a predetermined angle. The disc 73 rotates together with the rotational shaft 31. An assembly part 76 assembled with the disc 73 is formed at the end of the operation part 67. The assembly part 76 consists of a pair of ribs disposed in parallel with each other horizontally, which forms a guide groove in horizontal direction. The guide groove receives the edge of the disc 73, whereby the disc 73 and the assembly part 76 are engaged with each other.

When the rotational shaft 31 is rotated by the driving motor 35, the disc 73 rotates together with the rotational shaft 31, and the link member 61 engaged with the disc 73 is moved up and down.

Figure 14:
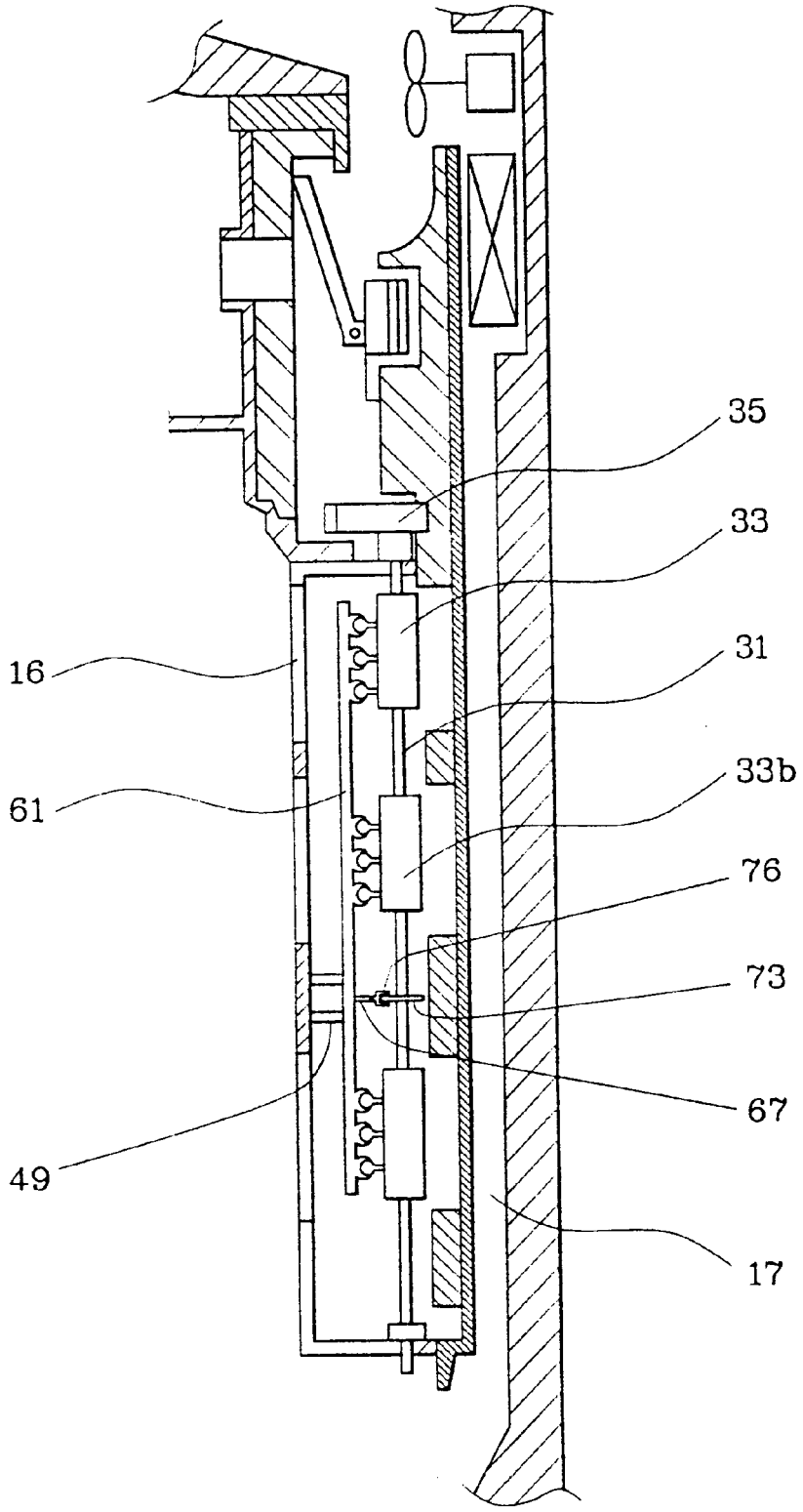
FIGS. 14 through 16 are side sectional views of FIG. 13, which show the cool air dispersing operation of the vertical dispersing blades.
Figure 15:
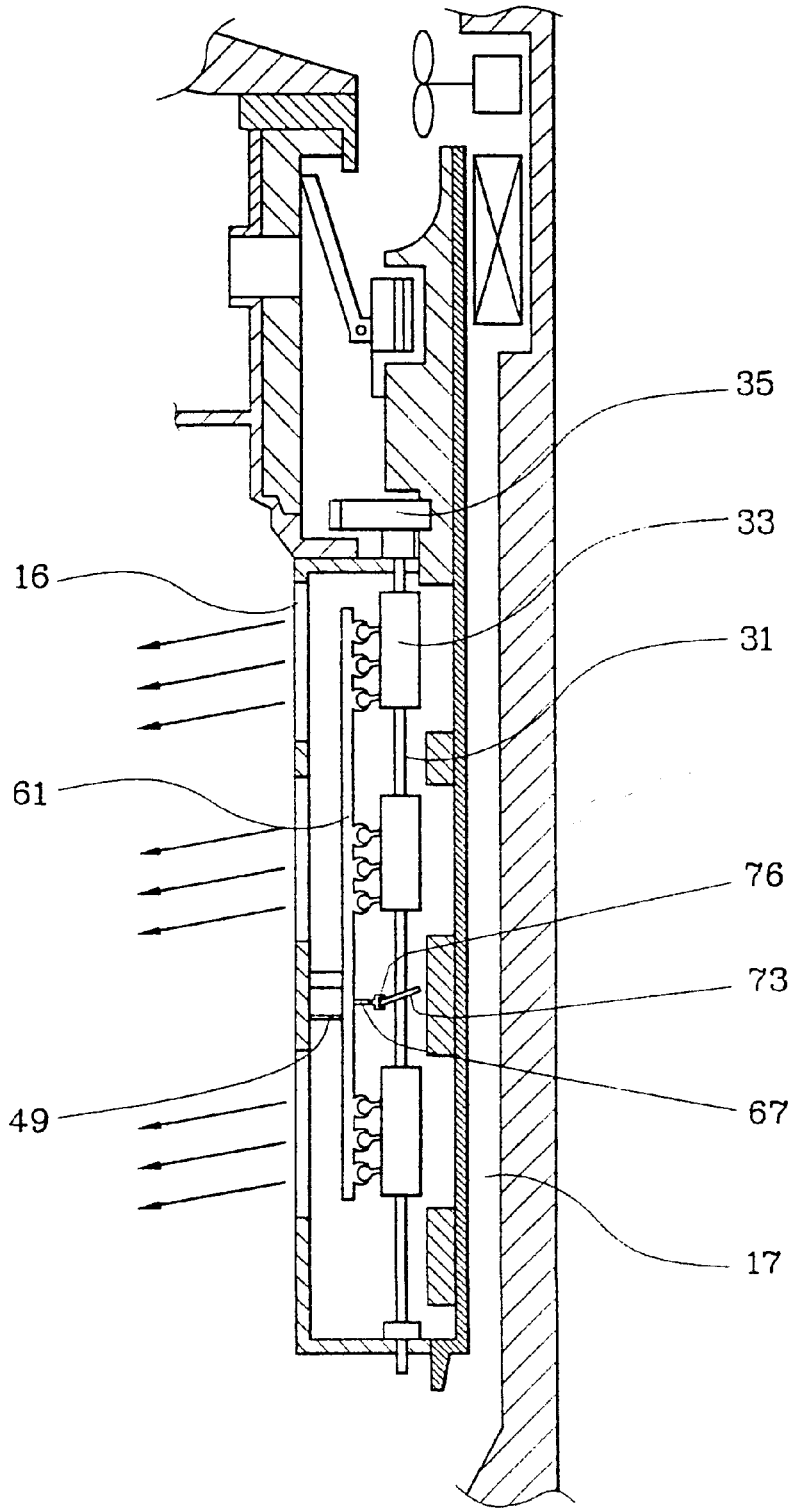
Figure 16:
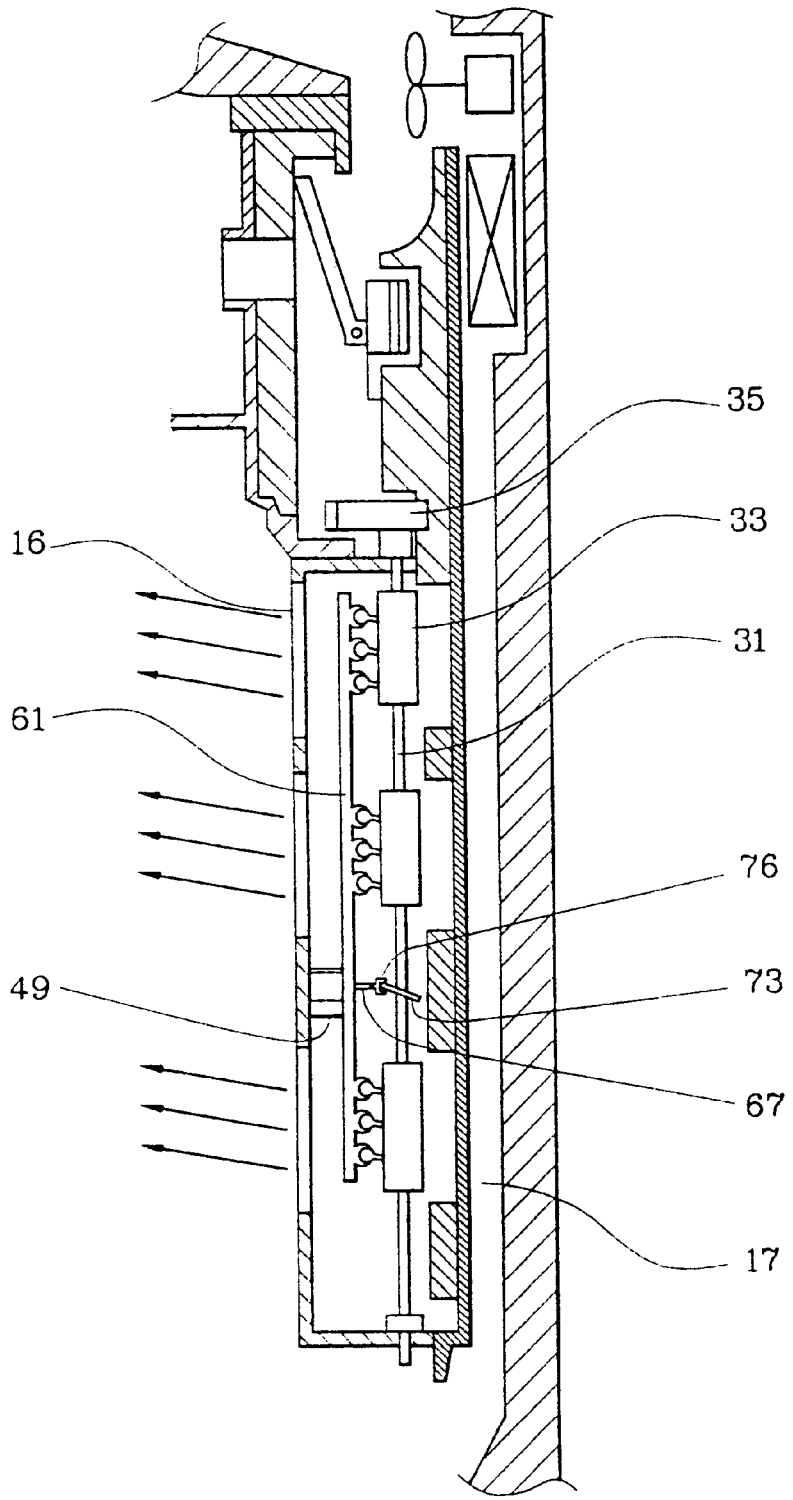

Therefore, as shown in FIGS. 14 through 16, the cool air is dispersed vertically while being dispersed horizontally. According to the present embodiment, there is an advantage that the construction of the cam for elevating/de-elevating the link member 61 is simple.

Figure 17:
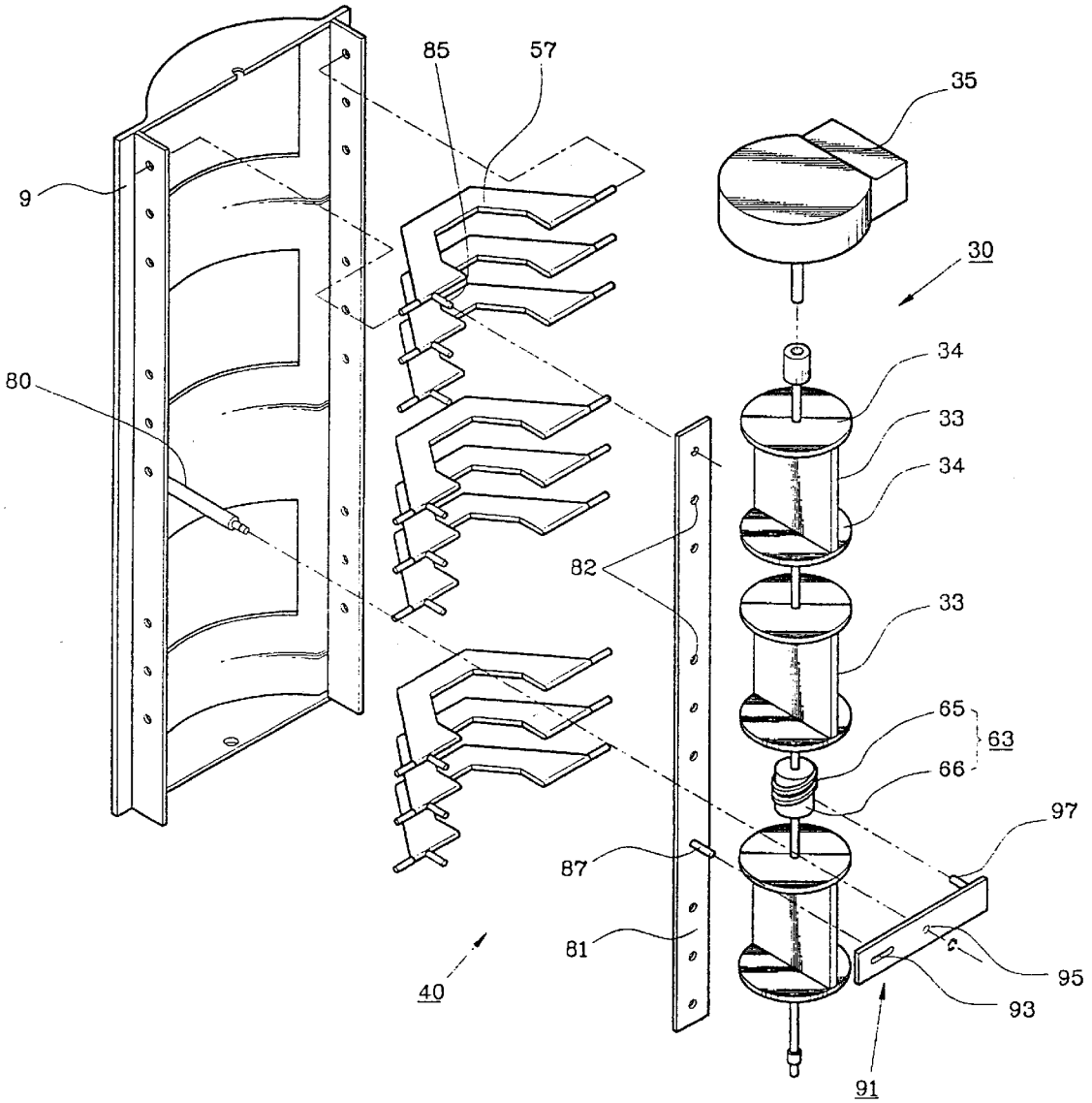
FIG. 17 is an exploded perspective view of the cool air dispersing device according to the third embodiment of the present invention.
Figure 18:
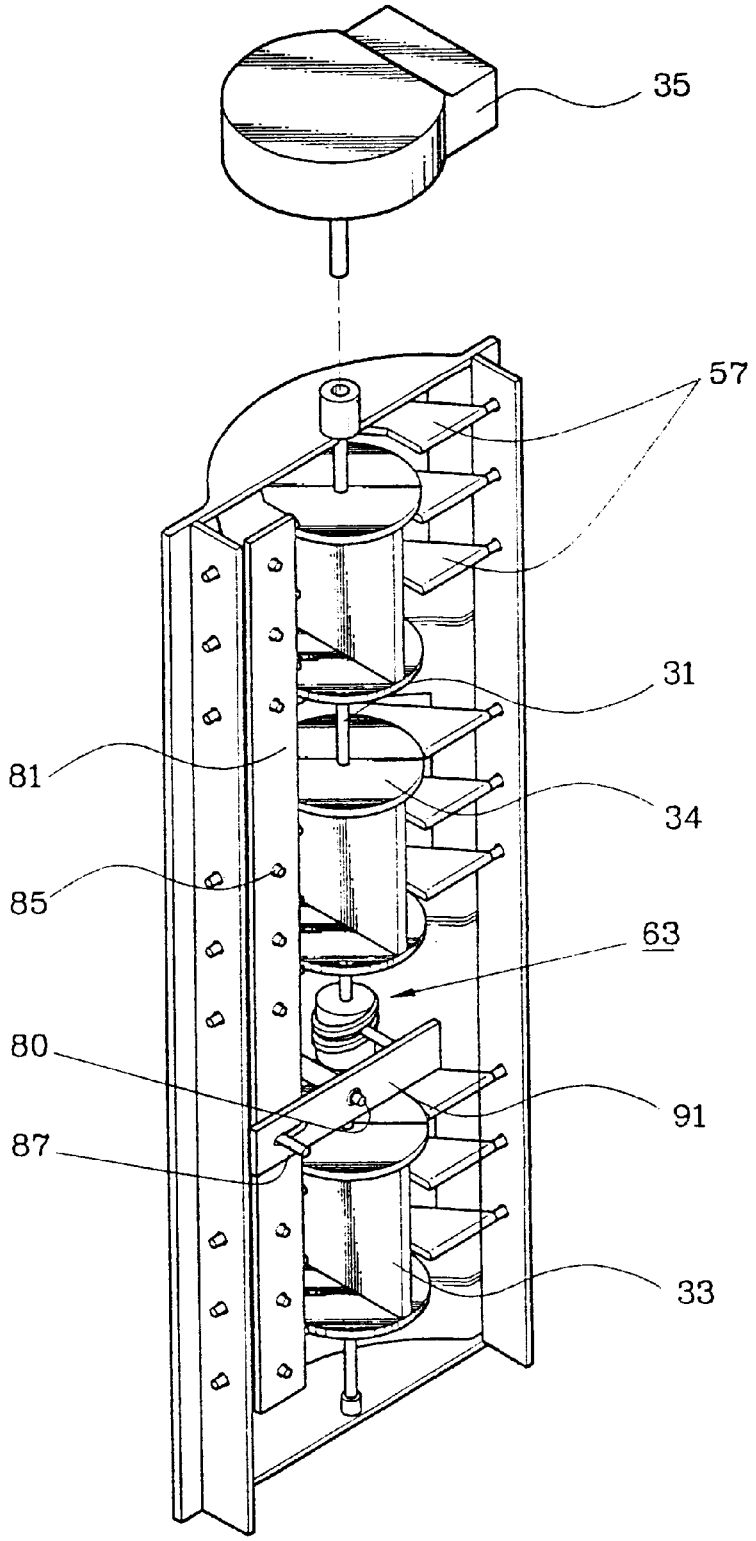
FIG. 18 is a perspective view showing the assembled state of FIG. 17.
Figure 19:
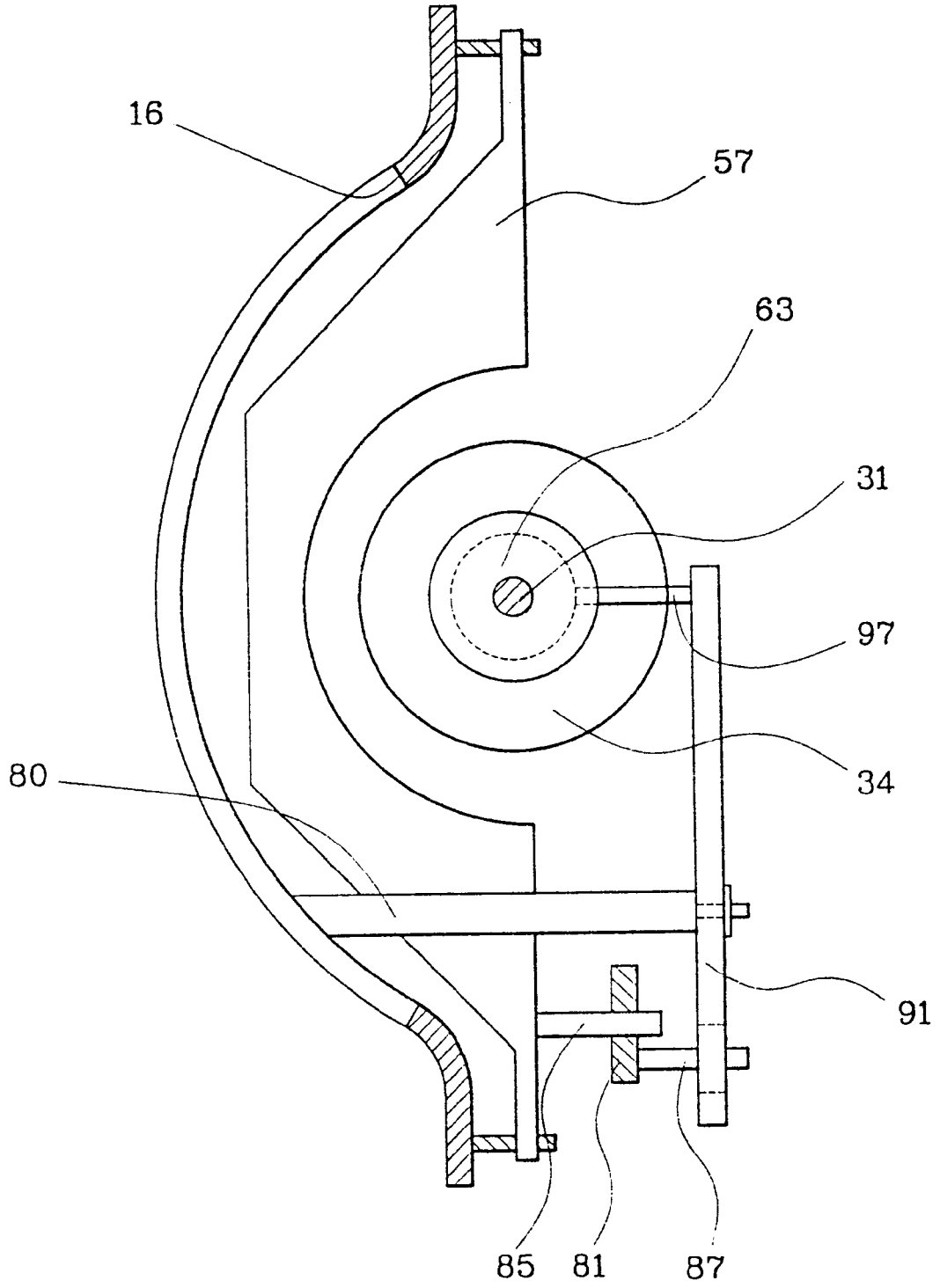
FIG. 19 is an enlarged transverse sectional view of FIG. 18.

FIGS. 17 through 19 show the third embodiment of the present invention.

In the present embodiment, the construction of the horizontal dispersing device 30 and the vertical dispersing device 40 is substantially the same with that of the first embodiment and the second embodiment. Furthermore, the construction of the elevation/de-elevation cam 63 installed on the rotational shaft 31 of the horizontal dispersing device 30 is the same with that of the first embodiment. However, the construction of the vertical pivoting means for driving the vertical dispersing device 40 is different from that of the aforementioned first and second embodiments.

In this embodiment, the vertical pivoting means includes pivoting pins 85 protruding from the respective vertical dispersing blades 57, a link member 81 engaged with the pivoting pins 85, and a lever member 91 connecting the elevation/de-elevation cam 63 and the link member 81 with each other.

The link member 81 is formed with a plurality of receiving holes 82 for receiving the pivoting pins 85 along the longitudinal direction thereof with being spaced from each other at a predetermined distance.

A lever supporting shaft 80 is formed at the inner side of the duct plate 9. The lever supporting shaft 80 is inserted into a shaft hole 95 formed at the central part of the lever member 91, whereby the lever member 91 is rotatably supported by the lever supporting shaft 80.

An operation part 87 protrudes at a part of the link member 81, and a guiding hole 93 assembled with the operation part 87 is formed on the lever member 91.

The guiding hole 93 is formed into a long hole so that the movement of the lever member 91 is easily converted to the elevational/de-elevational movement of the link member 81. The lever member 91 is formed with an elevation/de-elevation pin 97 inserted into the cam groove 65 of the elevation/de-elevation cam 63.

As the elevation/de-elevation cam 63 is rotated by the driving motor 35, the lever member 91 pivots upward and downward about the lever supporting shaft 80. The link member 81 is moved up and down by such a levering movement of the lever member 91. While the link member 81 is elevated/de-elevated, the vertical dispersing blades 57 assembled with the link member 81 through the pivoting pins 85 and the receiving holes 82 pivot upward and downward reciprocally. Therefore, the cool air is dispersed horizontally and vertically.

At both end of each horizontal dispersing blade 33 are installed guide plates 34. The cool air flowing down in the supply duct 15 strikes on the guide plates 34 to be guided toward the cool air discharge ports 16.

As described above, according to the present invention, a stable cool air flow and a uniform distribution of the cool air can be achieved without the vortex of the cool air about the cool air discharge ports. Furthermore, the uniform distribution of the cool air can be achieved not only in horizontal direction but also in vertical direction.

Although the present invention has been described and illustrated in detail, it is clearly understood that the same is by way of illustration and example only and is not to be taken by way of limitation, wherein the spirit and scope of the present invention is limited only by the terms of the appended claims.

What is claimed is:

1. A refrigerator having a cooling compartment for storing food, and a duct being provided in a side wall of said cooling compartment, said duct forming a cool air passage and having at least one cool air discharge port opened into said cooling compartment, said refrigerator comprising:

at least one horizontal-dispersing blade of planar plate shape being installed near the cool air discharge port in said duct, said horizontal-dispersing blade being disposed vertically according to a vertical axis;

a rotational shaft being connected with said horizontal-dispersing blade, said rotational shaft extending along the vertical axis;

a motor for rotating said rotational shaft;

at least one vertical-dispersing blade being installed near the cool air discharge port in said duct, said vertical-dispersing blade being capable of pivoting about a horizontal axis within a predetermined angular range; and a pivoting means for pivoting said vertical-dispersing blade in a vertical direction and comprising:

a link member having a hinge assembly part assembled with said vertical-dispersing blade at a position distanced from said horizontal axis, said link member being capable of moving up and down in the vertical direction, and elevating/de-elevating means for elevating/de-elevating said link member, comprising:

an elevation/de-elevation cam installed on said rotational shaft of said horizontal-dispersing blade, said elevation/de-elevation cam rotating together with said rotational shaft, and an operation part formed in a body with said link member, said operation part interacting with said elevation/de-elevation cam so that a rotational movement of said elevation/de-elevation cam is transmitted to said link member as an elevational/de-elevational movement thereof.

2. The refrigerator as claimed in claim 1, wherein said elevation/de-elevation cam has a cylindrical cam body coaxially installed on said rotational shaft, and a cam groove which is a closed loop having an elevational/de-elevational cam profile at an outer surface of said cam body; and said operation part protrudes from said link member and is engaged with said cam groove.

3. The refrigerator as claimed in claim 1, further comprising a means for guiding said link member so as to be capable of moving up and down vertically while preventing rotation of said link member.

4. The refrigerator as claimed in claim 3, wherein said guiding means comprises:

a guiding piece protruding from an axis of said link member; and a guiding part formed at an inner surface of said duct, said guiding part into which said guiding piece is inserted to be capable of moving up and down.

5. The refrigerator as claimed in claim 1, wherein said elevation/de-elevation cam is a disc installed on said rotational shaft so that a plane thereof is tilted against said rotational shaft at a predetermined angle, said disc rotating together with said rotational shaft; and said operation part protrudes from said link member and is engaged with said disc.

6. The refrigerator as claimed in claim 5, further comprising a means for guiding said link member so as to be capable of moving up and down vertically while preventing rotation of said link member.

7. The refrigerator as claimed in claim 6, wherein said guiding means comprises:

a guiding piece protruding from an axis of said link member; and a guiding part formed at an inner surface of said duct, said guiding part into which said guiding piece is inserted to be capable of moving up and down.

8. The refrigerator as claimed in claim 1, wherein said at least one vertical-dispersing blade comprises a plurality of vertical-dispersing blades arranged one above the other and pivotable about respective horizontal axes, said link member having a plurality of said hinge assembly parts assembled with respective ones of said vertical-dispersing blades.

9. A refrigerator having a cooling compartment for storing food, and a duct being provided in a side wall of said cooling compartment, said duct forming a cool air passage, said duct having at least one cool air discharge port opened into said cooling compartment, said refrigerator comprising:

at least one horizontal-dispersing blade of planar plate shape being installed near the cool air discharge port in said duct, said horizontal-dispersing blade being disposed vertically according to a vertical axis;

a rotational shaft being connected with said horizontal-dispersing blade, said rotational shaft being extended along the vertical axis;

a motor for rotating said rotational shaft;

at least one vertical-dispersing blade being installed near the cool air discharge port in said duct, said vertical-dispersing blade being capable of pivoting about a horizontal axis within a predetermined angular range; and a pivoting means for pivoting said vertical-dispersing blade in a vertical direction, comprising:

a pivoting pin protruding from said vertical-dispersing blade, a link member formed with a hole receiving said pivoting pin, said link member being capable of moving up and down in the vertical direction, an elevation de-elevation cam installed on said rotational shaft, said elevation/de-elevation cam rotating together with said rotational shaft, a lever member connecting said elevation/de-elevation cam with said link member, and a lever supporting shaft for supporting said lever member to be capable of rotating so that a rotational movement of said elevation/de-elevation cam is transmitted to an elevational/de-elevational movement of said link member by a levering movement of said lever member.

10. The refrigerator as claimed in claim 9, wherein said elevation/de-elevation cam has a cylindrical cam body coaxially installed on said rotational shaft, and a cam groove which is a closed loop having an elevational/de-elevational cam profile at an outer surface of said cam body; and said lever member has an operation part engaged with said cam groove.

11. The refrigerator as claimed in claim 9, further comprising a guide plate assembled at both ends of said horizontal dispersing blade, for guiding cool air flowing into said duct toward the cool air discharge ports.

12. The refrigerator as claimed in claim 9 wherein said at least one vertical-dispersing blade comprises a plurality of vertical-dispersing blades arranged one above the other and capable of pivoting about respective horizontal axes, there being a plurality of said pivoting pins protruding from respective ones of said vertical-dispersing blades, said link member formed with a plurality of said holes, said holes spaced vertically apart and receiving respective ones of said pivoting pins.

* * * * *